US009845518B2

(12) United States Patent
Cobo et al.

(10) Patent No.: US 9,845,518 B2
(45) Date of Patent: Dec. 19, 2017

(54) METHOD FOR FABRICATING STEEL SHEET FOR PRESS HARDENING, AND PARTS OBTAINED BY THIS METHOD

(71) Applicant: ArcelorMittal, Luxembourg (LU)

(72) Inventors: Sebastian Cobo, Ancy-sur-Moselle (FR); Juan David Puerta Velasquez, Metz (FR); Martin Beauvais, Marange Silvange (FR); Catherine Vinci, Jury (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 15/610,084

(22) Filed: May 31, 2017

(65) Prior Publication Data

US 2017/0298465 A1 Oct. 19, 2017

Related U.S. Application Data

(63) Continuation of application No. 15/500,090, filed as application No. PCT/IB2015/001273 on Jul. 29, 2015.

(30) Foreign Application Priority Data

Jul. 30, 2014 (WO) ..... PCT/IB2014/001428

(51) Int. Cl.
*C21D 9/00* (2006.01)
*B21B 3/02* (2006.01)
(Continued)

(52) U.S. Cl.
CPC ..... *C21D 9/0068* (2013.01); *B21B 3/02* (2013.01); *C21D 1/06* (2013.01); *C21D 8/005* (2013.01);
(Continued)

(58) Field of Classification Search
None
See application file for complete search history.

(56) References Cited

U.S. PATENT DOCUMENTS 9,611,517 B2 4/2017 Laurent et al.
2008/0199347 A1 8/2008 Barges et al.
(Continued)

FOREIGN PATENT DOCUMENTS

EP 1749895 A1 2/2007
EP 1767659 A1 3/2007
(Continued)

*Primary Examiner* — Adam Krupicka
(74) *Attorney, Agent, or Firm* — Davidson, Davidson & Kappel, LLC; Jennifer L. O'Connell; William C. Gehris

(57) ABSTRACT

The present invention provides a rolled steel sheet, for press hardening, for which the chemical composition includes, with contents expressed by weight, 0.24%≤C≤0.38%, 0.40%≤Mn≤3%, 0.10%≤Si≤0.70%, 0.015%≤Al≤0.070%, 0%≤Cr≤2%, 0.25%≤Ni≤2%, 0.015%≤Ti≤0.10%, 0%≤Nb≤0.060%, 0.0005%≤B≤0.0040%, 0.003%≤N≤0.010%, 0.0001%≤S≤0.005%, 0.0001%≤P≤0.025%, it being understood that the titanium and nitrogen content satisfy: Ti/N>3.42, and that the carbon, manganese, chromium and silicon content satisfy:

$$2.6C + \frac{Mn}{5.3} + \frac{Cr}{13} + \frac{Si}{15} \geq 1.1\%,$$

with the chemical composition optionally including one or more of the following elements: 0.05%≤Mo≤0.65%, 0.001%≤W≤0.30%, 0.0005%≤Ca≤0.005%, with the remainder made up of iron and inevitable impurities coming from preparation. The sheet includes a nickel content $Ni_{surf}$ at any point of the steel near the surface of said sheet over a depth
(Continued)

Δ, such that $Ni_{surf}>Ni_{nom}$, where $Ni_{nom}$ designates the nominal nickel content of the steel, and such that $Ni_{max}$ designates the maximum nickel content within Δ:

$$\frac{(Ni_{max}+Ni_{nom})}{2}\times(\Delta)\geq 0.6$$

and such that:

$$\frac{(Ni_{max}-Ni_{nom})}{\Delta}\geq 0.01,$$

with the depth Δ expressed in microns and the $Ni_{max}$ and $Ni_{nom}$ contents expressed in percentages by weight.

26 Claims, 5 Drawing Sheets

(51) Int. Cl.

| | |
|---|---|
| ***C22C 38/58*** | (2006.01) |
| ***C22C 38/54*** | (2006.01) |
| ***C22C 38/50*** | (2006.01) |
| ***C22C 38/48*** | (2006.01) |
| ***C22C 38/44*** | (2006.01) |
| ***C22C 38/14*** | (2006.01) |
| ***C22C 38/12*** | (2006.01) |
| ***C22C 38/08*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C23C 2/06*** | (2006.01) |
| ***C23C 2/12*** | (2006.01) |
| ***C23C 2/40*** | (2006.01) |
| ***C23C 2/28*** | (2006.01) |
| ***C21D 8/00*** | (2006.01) |
| ***C21D 1/06*** | (2006.01) |

(52) U.S. Cl.

CPC ..... *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/44* (2013.01); *C22C 38/48* (2013.01); *C22C 38/50* (2013.01); *C22C 38/54* (2013.01); *C22C 38/58* (2013.01); *C23C 2/06* (2013.01); *C23C 2/12* (2013.01); *C23C 2/28* (2013.01); *C23C 2/40* (2013.01); *C21D 2211/002* (2013.01); *C21D 2211/005* (2013.01); *C21D 2211/008* (2013.01); *C21D 2211/009* (2013.01)

(56) References Cited

U.S. PATENT DOCUMENTS

| | | | |
|---|---|---|---|
| 2008/0308194 | A1 | 12/2008 | Corquillet et al. |
| 2014/0076470 | A1 | 3/2014 | Zhu et al. |
| 2014/0170439 | A1 | 6/2014 | Allain et al. |
| 2014/0230970 | A1 | 8/2014 | Perlade et al. |

FOREIGN PATENT DOCUMENTS

| | | | |
|---|---|---|---|
| EP | 2137327 | B1 | 5/2012 |
| WO | 2012127125 | A1 | 9/2012 |
| WO | 2012153008 | A1 | 11/2012 |
| WO | 2012153016 | A1 | 11/2012 |

METHOD FOR FABRICATING STEEL SHEET FOR PRESS HARDENING, AND PARTS OBTAINED BY THIS METHOD

This is a continuation of U.S. patent application Ser. No. 15/500,090, filed Jan. 30, 2017 which is a National Stage of International Application PCT/IB2015/001273, filed Jul. 29, 2015 which claims priority of International Application PCT/IB2014/001428, filed Jul. 30, 2014. All of the above applications are hereby incorporated by reference herein.

The invention relates to a fabrication method for steel sheets intended to yield very high strength mechanical parts after press hardening.

BACKGROUND

As known, hardening by quenching in press (or press hardening) consists of heating steel blanks at a sufficiently high temperature to obtain an austenitic transformation, and then hot stamping the blanks by keeping them within the press tool so as to obtain quenched microstructures. According to a variant of the method, a cold pre-stamping can be done on the blanks in advance before heating and press hardening. These blanks can be precoated, for example with aluminum or zinc alloy. In this case, during heating in a furnace, the precoating alloys with the steel substrate by diffusion so as to create a compound providing surface protection of the part against decarburizing and formation of scale. This compound is suited for hot forming.

The resulting parts are in particular used as structural elements in automotive vehicles for providing anti-intrusion or energy absorption functions. Thus, the following can be cited as implementation examples: bumper crossbeams, door or center pillar reinforcements or frame rails. Such press hardened parts can also be used for example for fabricating tools or parts for agricultural machines.

Depending on the composition of the steel and the cooling speed obtained in the press, the mechanical strength can reach a higher or lower level. Thus, the publication EP 2,137,327 discloses a steel composition containing: $0.040\%<C<0.100\%$, $0.80\%<Mn<2.00\%$, $Si<0.30\%$, $S<0.005\%$, $P<0.030\%$, $0.010\%\leq Al\leq 0.070\%$, $0.015\%<Nb<0.100\%$, $0.030\%\leq Ti\leq 0.080\%$, $N<0.009\%$, Cu, Ni, $Mo<0.100\%$, $Ca<0.006\%$, with which a tensile mechanical strength Rm of over 500 MPa can be obtained after press hardening.

The publication FR 2,780,984 discloses a greater strength level being obtained: a steel sheet containing $0.15\%<C<0.5\%$, $0.5\%<Mn<3\%$, $0.1\%<Si<0.5\%$, $0.01\%<Cr<1\%$, $Ti<0.2\%$, Al and $P<0.1\%$, $S<0.05\%$, $0.0005\%<B<0.08\%$ enables a strength Rm over 1000 even over 1500 MPa to be obtained.

Such strengths are satisfactory for many applications. However, demands for reducing the energy consumption of vehicles drives the search for even lighter weight vehicles through the use of parts whose mechanical strength would be even higher, meaning whose strength $R_m$ would be over 1800 MPa. Since some parts are painted and undergo a paint baking cycle, this value is to be reached with or without thermal treatment by baking.

Now, such a level of strength is generally associated with a completely or very predominantly martensitic microstructure. It is known that this type of microstructure has a lower resistance to delayed cracking: after press hardening, the fabricated parts can in fact be susceptible to cracking or breaking after some time, under the conjunction of three factors:

- a mostly martensitic microstructure;
- a sufficient quantity of diffusible hydrogen. This can be introduced during furnace heating of the blanks before the step of hot stamping and press hardening: in fact, water vapor present in the furnace may break down and be adsorbed on the surface of the blank.
- the presence of a sufficient level of applied or residual stresses.

In order to resolve the problem of delayed cracking, rigorously controlling the atmosphere of the reheating furnaces and the conditions of cutting blanks was proposed in order to minimize the level of stresses. Performing thermal post treatments on hot stamped parts was also proposed in order to allow hydrogen degassing. These operations are however constraining for the industry which wants a material that enables avoidance of this risk and overcomes these additional constraints and costs.

Depositing specific coatings on the surface of the steel sheet which reduces hydrogen adsorption was also proposed. However, a simpler process is sought which offers equivalent delayed cracking resistance.

BRIEF SUMMARY

Therefore, one is looking for a fabrication method for parts which would offer simultaneously a very high mechanical strength Rm, and a high resistance to delayed cracking after press hardening; these objectives being a priori difficult to reconcile.

Further, it is known that steel compositions richer in quench-promoting and/or hardening elements (C, Mn, Cr, Mo, etc.) lead to obtaining hot rolled sheets with a higher hardness. Thus, this increased hardness is detrimental for obtaining cold rolled sheets over a large range of thicknesses, considering the limited rolling capacity of some cold rolling mills. A too-high level of strength at the hot rolled sheet stage therefore does not allow very thin cold rolled sheets to be obtained. A method which provides a large range of cold rolled sheet thicknesses is therefore sought.

Additionally, the presence of quench-promoting and/or hardening elements in larger quantities can have consequences during thermomechanical treatment for fabrication because a variation of some parameters (end of rolling temperature, coiling temperature, variation of cooling speed over the width of the rolled strip) may lead to a variation of the mechanical properties within the sheet. A steel composition less sensitive to a variation of certain fabrication parameters is therefore sought so as to fabricate a sheet having good mechanical property homogeneity.

A steel composition is also sought which can be easily coated, in particular through hot-dip, such that the sheet can be available in different forms: uncoated, or coated with aluminum alloy or zinc alloy depending on end-user specifications.

A process is also sought that provides a sheet having good suitability for the mechanical cutting step in order to obtain blanks intended for press hardening, i.e., whose mechanical strength would not be too high at that stage in order to avoid breakdown of the cutting or punching tools.

A goal of the present invention is to resolve all of the problems discussed above by means of an economical fabrication method.

Surprisingly, the inventors have shown that these problems were resolved by supplying a sheet with the composition detailed below, where this sheet furthermore had the feature of having a specific enrichment with nickel in the area of the surface thereof.

For this purpose, present invention provides a rolled steel sheet, for press hardening, for which the chemical composition comprises, with contents expressed by weight: 0.24%≤C≤0.38%, 0.40%≤Mn≤3%, 0.10%≤Si≤0.70%, 0.015%≤Al≤0.070%, 0%≤Cr≤2%, 0.25%≤Ni≤2%, 0.015%≤Ti≤0.10%, 0%≤Nb≤0.060%, 0.0005%≤B≤0.0040%, 0.003%≤N≤0.010%, 0.0001%≤S≤0.005%, 0.0001%≤P≤0.025%, with it being understood that the titanium and nitrogen content satisfy: Ti/N>3.42, and that the carbon, manganese, chromium and silicon content satisfy:

$$2.6C + \frac{Mn}{5.3} + \frac{Cr}{13} + \frac{Si}{15} \geq 1.1\%,$$

with the chemical composition optionally comprising one or more of the following elements: 0.05%≤Mo≤0.65%, 0.001%≤W≤0.30%, 0.0005%≤Ca≤0.005%, with the remainder made up of iron and inevitable impurities coming from preparation, the sheet containing a nickel content $Ni_{surf}$ at any point of the steel near the surface of said sheet over a depth Δ, such that $Ni_{surf}>Ni_{nom}$, where $Ni_{nom}$ designates the nominal nickel content of the steel, and such that $Ni_{max}$ designates the maximum nickel content within Δ

$$\frac{(Ni_{max} + Ni_{nom})}{2} \times (\Delta) \geq 0.6$$

and such that $$\frac{(Ni_{max} + Ni_{nom})}{\Delta} \geq 0.01,$$

with the depth Δ expressed in microns and the $Ni_{max}$ and $Ni_{nom}$ contents expressed in percentages by weight.

According to a first embodiment, the composition of the sheet comprises, by weight: 0.32%≤C≤0.36%, 0.40%≤Mn≤0.80%, 0.05%≤Cr≤1.20%.

According to a second embodiment, the composition of the sheet comprises, by weight: 0.24%≤C≤0.28%, 1.50%≤Mn≤3%.

The silicon content of the sheet is preferably such that: 0.50%≤Si≤0.60%.

According to a further embodiment, the composition comprises, by weight: 0.30%≤Cr≤0.50%.

Preferably, the composition of the sheet comprises, by weight: 0.30%≤Ni≤1.20%, and very preferably: 0.30%≤Ni≤0.50%.

The titanium content is preferably such that: 0.020%≤Ti.

The composition of the sheet advantageously comprises: 0.020%≤Ti≤0.040%.

According to a preferred embodiment, the composition comprises, by weight: 0.15%≤Mo≤0.25%.

The composition preferably comprises by weight: 0.010%≤Nb≤0.060%, and very preferably: 0.030%≤Nb≤0.050%.

According to a further embodiment, the composition comprises, by weight: 0.50%≤Mn≤0.70%.

Advantageously, the microstructure of the steel sheet is ferritic-pearlitic.

According to a preferred embodiment, the steel sheet is a hot rolled sheet.

Preferably, the sheet is a hot rolled and annealed sheet.

According to a further embodiment, the steel sheet is precoated with a metal layer of aluminum or aluminum alloy or aluminum-based alloy.

According to another embodiment, the steel sheet is precoated with a metal layer of zinc or zinc alloy or zinc-based alloy.

According to another embodiment, the steel sheet is precoated with one coat or several coats of inter-metallic alloys containing aluminum and iron and possibly silicon, where the precoating does not contain free aluminum, of phase $\tau_5$ of type $Fe_3Si_2Al_{12}$, and $\tau_6$ of type $Fe_2Si_2Al_9$.

The present invention also provides a part obtained by press hardening of a steel sheet of composition according to any one of the modes above with martensitic or martensitic-bainitic structure.

Preferably, the press hardened part contains a nominal nickel content $Ni_{nom}$, in which the nickel content $Ni_{surf}$ in the steel near the surface is greater than $Ni_{nom}$ over a depth Δ, and in that, $Ni_{max}$ designating the maximum nickel content within Δ

$$\frac{(Ni_{max} + Ni_{nom})}{2} \times (\Delta) \geq 0.6$$

and in that:

$$\frac{(Ni_{max} + Ni_{nom})}{\Delta} \geq 0.01,$$

where the depth Δ is expressed in microns and the contents $Ni_{max}$ and $Ni_{nom}$ are expressed in percentage by weight.

Advantageously, the press hardened part has a mechanical strength Rm greater than or equal to 1800 MPa.

According to a preferred embodiment, the press hardened part is coated with an aluminum or aluminum-based alloy, or a zinc or zinc-based alloy, resulting from the diffusion between the steel substrate and the precoating during the thermal treatment of press hardening.

The present invention also provides a fabrication method for a hot rolled steel sheet comprising the successive steps according to which an intermediate product with chemical composition according to the one of the embodiments presented above is cast, and then reheated to a temperature between 1250° C. and 1300° C. for a hold time at this temperature between 20 and 45 minutes. The intermediate product is hot rolled until an end of rolling temperature, ERT, between 825° C. and 950° C. in order to obtain a heat rolled sheet, and then the hot rolled sheet is coiled at a temperature between 500° C. and 750° C. in order to obtain a hot rolled and coiled, and then the oxide layer formed during the preceding steps is removed by pickling.

The present invention further provides a fabrication method for cold rolled and annealed sheet, characterized in that it comprises the successive steps according to which a hot rolled sheet is supplied, coiled and pickled, fabricated by the method described above and then this hot rolled, coiled and pickled sheet is cold rolled in order to obtain a cold rolled sheet. This cold rolled sheet is annealed at a temperature between 740° C. and 820° C. in order to obtain a cold rolled and annealed sheet.

According to an advantageous embodiment, a rolled sheet fabricated according to one of the above methods is supplied and then a continuous precoating is performed by hot-dip, where the precoating is aluminum or an aluminum or aluminum-based alloy, or zinc or a zinc or zinc-based alloy.

Advantageously the present invention even further provides a fabrication method for a precoated and pre-alloyed sheet according to which a sheet rolled according to one of the above methods is supplied and then a continuous hot-dip precoating is performed with an aluminum or aluminum-based alloy and then a thermal pretreatment of the precoated sheet is done at a temperature $\theta_1$ between 620 and 680° C. for a hold time $t_1$ between 6 and 15 hours, such that the pre-coating no longer contains free aluminum of phase $\tau_5$ of type $Fe_3Si_2Al_{12}$, and $\tau_6$ of type $Fe_2Si_2Al_9$, and such that an austenitic transformation is not caused in the steel substrate, where the pretreatment is done in a furnace under hydrogen and nitrogen atmosphere.

An the present invention also provides a fabrication method for a press hardened part comprising successive steps according to which a sheet fabricated by a method according to one of the modes above is supplied and then said sheet is cut in order to obtain a blank and then an optional step of deformation by cold stamping is performed on the blank. The blank is heated to a temperature comprised between 810° C. and 950° C. in order to get a fully austenitic structure in the steel and then the blank is transferred inside a press. The blank is hot stamped in order to obtain a part and then it is held inside the press in order to obtain a hardening by martensitic transformation of the austenitic structure.

An the present invention provides for the use of a press hardened part comprising the characteristics presented above or fabricated according to the method presented above for the fabrication of structural or reinforcing parts for vehicles.

BRIEF DESCRIPTION OF THE DRAWINGS

Other characteristics and advantages of the invention will appear during the following description given as an example and with reference made to the following attached figures.

DETAILED DESCRIPTION

Figure 1:
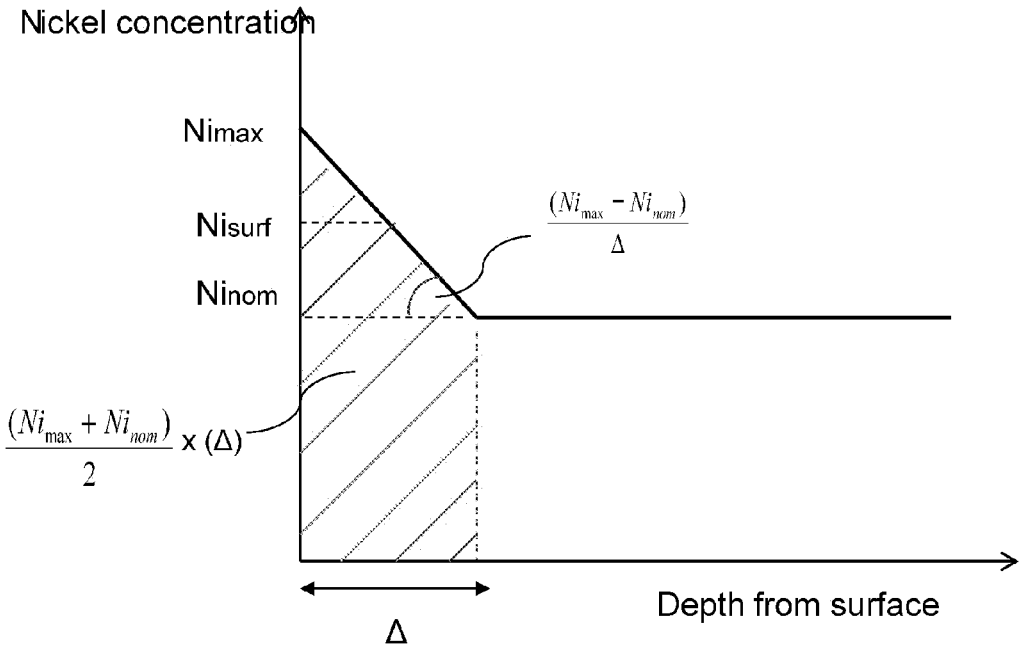
FIG. 1 shows schematically the variation of nickel content near the surface of the press hardened sheets or parts and illustrates certain parameters defining the invention: $Ni_{max}$, $Ni_{surf}$, $Ni_{nom}$ and $\Delta$.

The thickness of the sheet metal implemented in the method according to the invention is preferably comprised between 0.5 mm and 4 mm, a thickness range notably used in the fabrication of structural or reinforcing parts for the automotive industry. This can be obtained by hot rolling or be the subject of a subsequent cold rolling and an annealing. This thickness range is suited to industrial press hardening tools, in particular hot stamping presses.

Advantageously, the steel contains the following elements, with the composition expressed by weight.

A carbon content comprising between 0.24% and 0.38%. This element plays a major role in the quenchability and the mechanical strength obtained after the cooling which follows the austenitization treatment. Below a content of 0.24% by weight, the 1800 MPa mechanical strength level cannot be reached after hardening by tempering in press, without further addition of costly elements. Above a content of 0.38% by weight, the risk of delayed cracking is increased and the ductile/brittle transition temperature, measured with Charpy type notched flexion tests, becomes greater than −40° C., which is seen as a too significant reduction of the toughness.

With a carbon content comprised between 0.32% and 0.36% by weight, the targeted properties can be obtained stably while keeping the weldability at a satisfactory level and limiting the production costs.

The suitability for spot welding is particularly good when the carbon content is comprised between 0.24% and 0.28%.

As will be seen later, the carbon content must also be defined in conjunction with the manganese, chromium and silicon contents.

In addition to its role as deoxidizer, manganese plays a role in the quenchability: the content thereof must be greater than 0.40% by weight to obtain a sufficiently low transformation start temperature Ms (austenite→martensite) during cooling in press, which makes it possible to increase the strength Rm. An increased resistance to delayed cracking can be obtained by limiting the manganese content to 3%. In fact, manganese segregates to the austenitic grain boundaries and increases the risk of intergranular rupture in the presence of hydrogen. On the other hand, as will be explained later, the resistance to delayed cracking comes in particular from the presence of a nickel enriched surface layer. Without wanting to be bound by a theory, it is thought that when the manganese content is excessive, a thick oxide layer is created during reheating of the slabs, so long as the nickel does not have time to sufficiently diffuse to be located under this iron and manganese oxide layer.

The manganese content is preferably defined jointly with the carbon and possibly chromium content:

when the carbon content comprises between 0.32% and 0.36% by weight, with a manganese content comprising between 0.40% and 0.80% and a chromium content comprising between 0.05% and 1.20%, an excellent resistance to delayed cracking because of the presence of a particularly effective nickel enriched surface layer and simultaneously a very good suitability for mechanical cutting of the sheets can be obtained. The manganese content ideally comprises between 0.50% and 0.70% to conciliate the obtention of high mechanical strength and resistance to delayed cracking.

when the carbon content comprises between 0.24% and 0.28% combined with a manganese content comprising between 1.50% and 3% the suitability for spot welding is particularly good.

These composition ranges make it possible to obtain a cooling transformation (austenite→martensite) start temperature Ms comprised between about 320° C. and 370° C. and in this way it can be guaranteed that the heat hardened parts have a sufficiently high strength.

The silicon content of the steel must comprise between 0.10% and 0.70% by weight: with a silicon content over 0.10%, an additional hardening can be obtained and the silicon contributes to the deoxidation of the liquid steel. The content thereof must however be limited to 0.70% in order to avoid the excessive formation of surface oxides during reheating and/or annealing steps and to not impair the hot-dip coatability.

The silicon content is preferably over 0.50% in order to avoid a softening of the fresh martensite, which can occur when the part is held in the press tool after the martensitic transformation. The silicon content is preferably below 0.60% in order that the heating transformation temperature Ac3 (ferrite+pearlite→austenite) not be too high. Otherwise, this requires reheating the blanks to a higher temperature before hot stamping, which reduces the productivity of the method.

In quantities greater than or equal to 0.015%, aluminum is an element enabling deoxidation in the liquid metal during elaboration, and the precipitation of nitrogen. When its content is over 0.070%, it can form coarse aluminates during steel-making which tend to reduce the ductility. Optimally, the content thereof is comprised between 0.020% and 0.060%.

Chromium increases the quenchability and contributes to the obtention of the Rm level desired after press hardening. Above a content equal to 2% by weight, the effect of chromium on the homogeneity of the mechanical properties in the press hardened part is saturated. At a quantity preferably comprised between 0.05% and 1.20%, this element contributes to increasing the strength. Preferably, the desired effects on the mechanical strength and delayed cracking can be obtained by adding chromium comprised between 0.30% and 0.50% while limiting the additional cost. When the manganese content is sufficient, i.e., comprised between 1.50% and 3% manganese, the addition of chromium is considered optional because the quenchability obtained through the manganese is considered sufficient.

Figure 2:
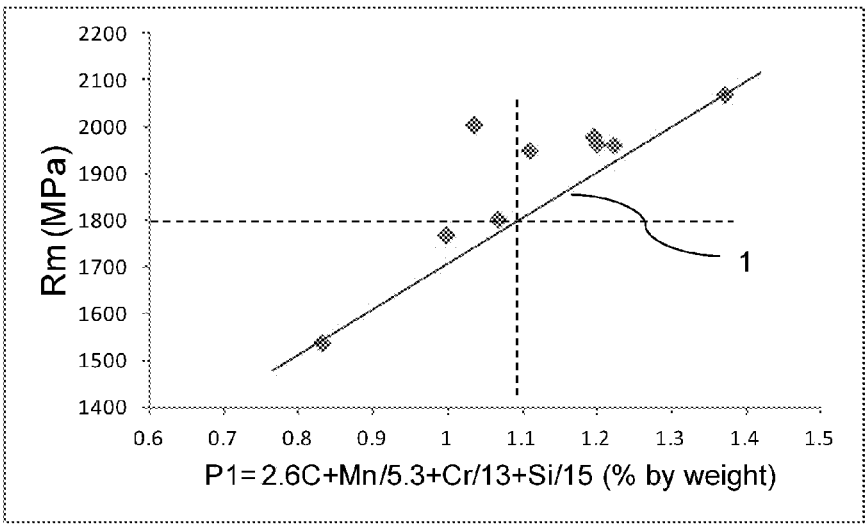
FIG. 2 shows the mechanical strength of hot stamped and press hardened parts as a function of a parameter combining the C, Mn, Cr and Si contents of the sheets.

Furthermore to the conditions on each of the elements C, Mn, Cr and Si defined above, the inventors have shown that these elements should be specified jointly: in fact, FIG. 2 shows the mechanical strength of the press hardened blanks for different steel compositions with variable contents of carbon (between 0.22% and 0.36%), manganese (between 0.4% and 2.6%), chromium (between 0% and 1.3%) and silicon (between 0.1% and 0.72%) as a function of the parameter $$P_1 = 2.6C + \frac{Mn}{5.3} + \frac{Cr}{13} + \frac{Si}{15}$$

The data shown in FIG. 2 relate to heated blanks in the austenitic domain at a temperature of 850° C. or 900° C. held at this temperature for 150 seconds and then hot stamped and quenched by holding in the tool. In all cases, the structure of the parts resulting after hot stamping is entirely martensitic. The straight line 1 designates the lower envelope of the mechanical strength results. Despite the dispersion due to the variety of compositions studied, it appears that a minimum value of 1800 MPa is obtained when the parameter $P_1$ is greater than 1.1%. When this condition is satisfied, the Ms transformation temperature during press cooling is below 365° C. Under these conditions, the self-tempered martensite fraction, under the effect of holding in the press tool, is extremely limited, so that the very high quantity of untempered martensite allows a high mechanical strength value to be obtained.

Titanium has a high affinity for nitrogen. Considering the nitrogen content of the steels of the invention, the titanium content must be greater than or equal to 0.015% so as to obtain an effective precipitation. At quantities over 0.020% by weight, the titanium protects the boron such that this element is found in a free form for playing its full effect on the quenchability. The content thereof must be greater than 3.42 N, where this quantity is defined by the stoichiometry of the TiN precipitation so as to avoid the presence of free nitrogen. Beyond 0.10%, there is however a risk of forming course titanium nitrides in the liquid steel which play a harmful role on the toughness. The titanium content is preferably. comprised between 0.020% and 0.040%, so as to create fine nitrides which limit the growth of austenitic grains during reheating of the blanks prior to hot stamping.

In quantities over 0.010% by weight, niobium forms niobium carbonitrides which may also limit the growth of austenitic grains during reheating of the blanks. The content thereof must however be limited 0.060% because of its capacity to limit recrystallization during hot rolling which increases the rolling forces and the fabrication difficulty. The optimum effects are obtained when the niobium content is comprised between 0.030% and 0.050%.

In quantities over 0.0005% by weight, boron increases the quenchability very strongly. By diffusing into the joints of the austenitic grain boundaries, it exerts a favorable influence by preventing the intergranular segregation of phosphorus. Over 0.0040%, this effect is saturated.

A nitrogen content over 0.003% makes it possible to obtain precipitation of TiN, Nb(CN) or (Ti, Nb)(CN) mentioned above in order to limit the growth of the austenitic grain. The content must however be limited to 0.010% so as to avoid the formation of coarse precipitates.

Optionally, the sheet may contain molybdenum in a quantity comprised between 0.05% and 0.65% by weight: this element forms a co-precipitate with niobium and titanium. These precipitates are thermally very stable, strengthening the limitation of the growth of the austenitic grain on heating. An optimal effect is obtained for a molybdenum content comprised between 0.15% and 0.25%.

As an option, the steel can also comprise tungsten in a quantity comprised between 0.001% and 0.30% by weight. In the quantities indicated, this element increases the quenchability and the hardenability because of the formation of carbides.

Optionally, the steel may also contain calcium in a quantity comprised between 0.0005% and 0.005%: by combining with oxygen and sulfur, the calcium makes it possible to avoid the formation of large-size inclusions which negatively affect the ductility of the sheets or parts fabricated in that way.

In excessive quantities, sulfur and phosphorus lead to an increased brittleness. This is why the content by weight of sulfur is limited to 0.005% in order to avoid an excessive formation of sulfides. An extremely low sulfur content, i.e., below 0.001%, is however unnecessarily costly to achieve insofar as it does not provide an additional benefit.

For similar reasons, the phosphorus content is comprised between 0.001% and 0.025% by weight. At an excessive content, this element segregates into the joints of the austenitic grains and increases the risk of delayed cracking by intergranular rupture.

Nickel is an important element of the invention: in fact, the inventors have shown that this element, in a quantity comprised between 0.25% and 2% by weight, very substantially reduces the sensitivity to delayed fracture when it is located concentrated at the surface of the sheet or parts in a specific form.

For that, reference is made to FIG. 1 which schematically shows some characteristic parameters of the invention: the variation of the nickel content of a steel near the surface of the sheet, for which a surface enrichment was noted, is presented. For reasons of convenience, only one of the surfaces of the sheet was shown, it is understood that the following description applies to the other surfaces of this sheet as well. The steel has a nominal nickel content $Ni_{nom}$. Due to the fabrication method which will be described later, the steel sheet is enriched with nickel in the area of its surface, up to a maximum $Ni_{max}$. This maximum $Ni_{max}$ can be found at the surface of the sheet, as shown in FIG. 1, or slightly under this surface, a few tens or hundreds of nanometers therebelow, without that changing the following description and the results of the invention. Similarly, the variation in the nickel content may not be linear, as shown schematically in FIG. 1, but adopt a characteristic profile resulting from diffusion phenomena. For that matter, the following definition of characteristic parameters is also valid for this type of profile. The nickel enriched surface zone is therefore characterized by the fact that in any point, the local nickel content $Ni_{surf}$ of the steel is such that: $Ni_{surf}>Ni_{nom}$. This enriched zone has a depth Δ.

Surprisingly, the inventors showed that a resistance to delayed cracking is obtained by considering two parameters $P_2$ and $P_3$ characteristic of the enriched surface area, which must satisfy some critical conditions. First, one defines:

$$P_2 = \frac{(Ni_{max} + Ni_{nom})}{2} \times (\Delta)$$

This first parameter describes the overall nickel content in the enriched layer Δ and corresponds to the hashed area shown in FIG. 1.

The second parameter $P_3$ is defined by:

$$P_3 = \frac{(Ni_{max} - Ni_{nom})}{\Delta}$$

This second parameter describes the average nickel content gradient, i.e., the amount of enrichment within the layer Δ.

The inventors sought conditions that prevent delayed cracking of press hardened parts with very high mechanical strength. One recalls that this method provides steel blanks, whether bare or precoated with a metal coating (aluminum or aluminum alloy, or zinc or zinc alloy) that are heated and next transferred into a hot stamping press. During the heating step, water vapor possibly present in the furnace in a more or less significant quantity is adsorbed on the surface of the blank. Hydrogen arising from the dissociation of the water can be dissolved in the austenitic steel substrate at high temperature. The introduction of hydrogen is therefore facilitated by a furnace atmosphere with a high dewpoint, a significant austenitization temperature and a long hold time. During cooling, the solubility of the hydrogen drops sharply. After return to ambient temperature, the coating formed by alloying between the possible metal precoating and the steel substrate forms a practically sealed barrier to hydrogen desorption. A significant diffusible hydrogen content will therefore increase the risks of delayed cracking for a steel substrate with martensitic structure. The inventors have therefore sought means with which to lower the diffusible hydrogen content over a hot stamped part to a very low level, i.e., less than or equal to 0.16 ppm. This level serves to guarantee that a part stressed in flexion under a stress equal to that of the yield stress of the material, for 150 hours, will not exhibit cracking.

They showed that this result is achieved when the surface of the hot stamped part or that of the sheet or blank before hot stamping has the following specific properties.

Figure 3:
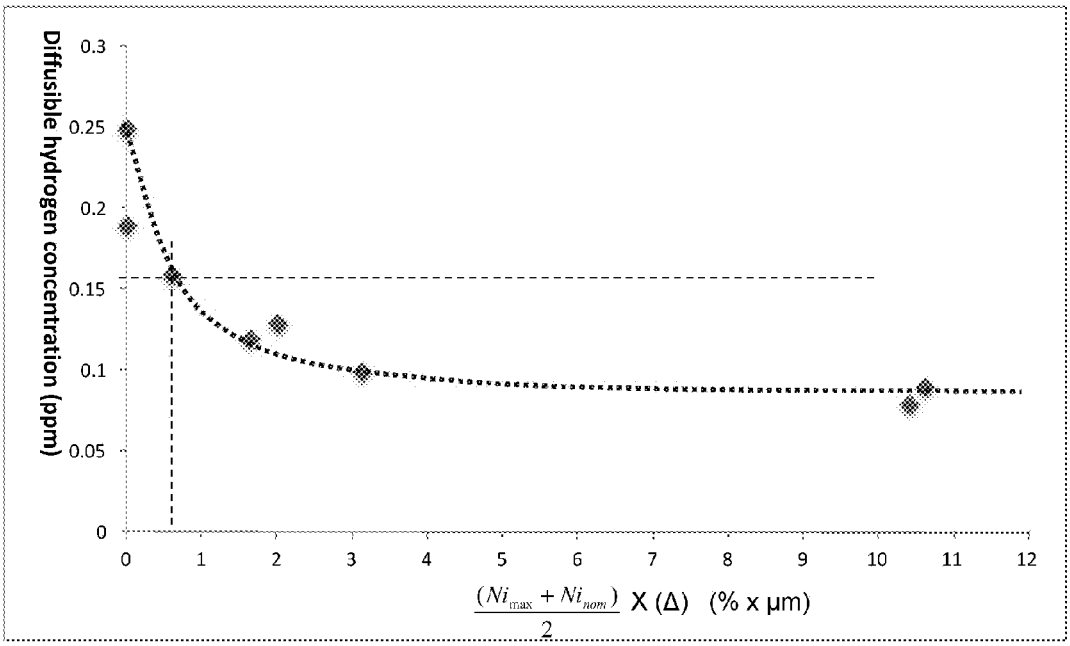
FIG. 3 shows the diffusible hydrogen content measured on hot stamped and press hardened parts as a function of a parameter expressing the total nickel content near the surface of the sheets.

FIG. 3, established for press hardened parts with strength Rm comprising between 1800 MPa and 2140 MPa shows that the diffusible hydrogen content depends on the parameter $P_2$ above. A diffusible hydrogen content below 0.16 ppm is obtained when $$\frac{(Ni_{max} + Ni_{nom})}{2} \times (\Delta) \geq 0.6,$$

where the depth Δ is expressed in microns and the contents $Ni_{max}$ and $Ni_{nom}$ are expressed in percentage by weight.

Figure 4:
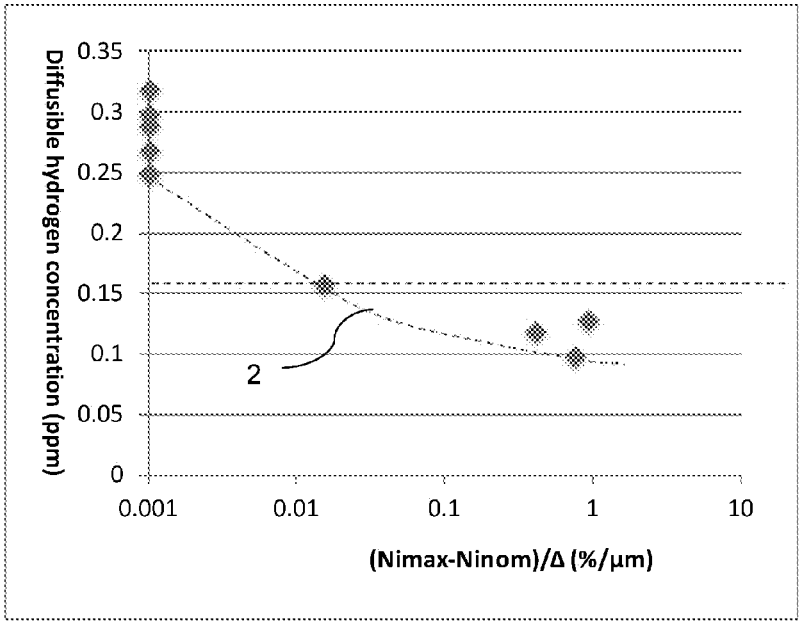
FIG. 4 shows the diffusible hydrogen content measured on hot stamped and press hardened parts as a function of a parameter expressing the amount of enrichment with nickel in the surface layer of the sheets.

In FIG. 4, concerning the same press hardened parts, the inventors have also shown that the diffusible hydrogen content below 0.16 ppm was achieved when the nickel enrichment in the layer Δ reached a critical value compared to the nominal content $Ni_{nom}$, i.e., when the parameter $P_3$ satisfied:

$$\frac{(Ni_{max} + Ni_{nom})}{\Delta} \geq 0.01,$$

the units being the same as for the parameter $P_2$. In FIG. 4, curve 2, corresponding to the lower envelope of the results, is shown.

Without wanting to be bound to a theory, it is thought that these features create a barrier effect against penetration of hydrogen into the sheet at high temperature, in particular by a nickel enrichment at the former austenitic grain joints, which limits hydrogen diffusion.

The remainder of the composition of the steel is made up of iron and inevitable impurities resulting from elaboration.

The method according to the invention will now be described: an intermediate product of the composition indicated above is cast. This intermediate product may be in slab shape of thickness typically comprising between 200 mm and 250 mm, or thin slab shape whose typical thickness is on the order of a few tens of millimeters, or any other appropriate shape. It is brought to a temperature comprised between 1250° C. and 1300° C. and held in this temperature range for a time comprised between 20 and 45 minutes. For the steel composition from the invention, an oxide layer essentially rich in iron and manganese forms by reaction with the oxygen from the atmosphere of the furnace; in that layer the nickel solubility is very low and the nickel remains in metallic form. In parallel with the growth of this oxide layer, nickel diffuses towards the interface between the oxide and the steel substrate thus causing the appearance of a layer enriched in nickel within the steel. At this stage, the thickness of this layer depends in particular on the nominal nickel content of the steel and the temperature and holding conditions previously defined. During the subsequent fabrication cycle, this initial enriched layer simultaneously undergoes:

a thinning, due to the rate of reduction conferred by the successive rolling steps;

a thickening, due to the sheet being kept at high temperature during successive fabrication steps. This thickening however occurs in smaller proportions than during the step of reheating the slabs.

The fabrication cycle of a hot rolled sheet typically comprises:

steps of hot rolling (e.g., rough rolling, finishing) in a temperature range extending from 1250° C. to 825° C.;

coiling in a temperature range extending from 500° C. to 750° C.

The inventors have shown that a variation of the hot rolling and coiling parameters, in the ranges defined by the invention, does not substantially modify the mechanical properties, since the process tolerated some variation within these ranges so well, without notable impact on the resulting products.

At this stage, the hot rolled sheet, whose thickness can typically be 1.5 mm to 4.5 mm, is pickled by a process known per se, which eliminates the oxide layer, such that the nickel enriched layer is located near the surface of the sheet.

When it is desired to obtain a thinner sheet, cold rolling is done with a suitable reduction rate, for example comprised between 30% and 70% and then annealing at a temperature typically comprised between 740° C. and 820° C. so as to obtain a recrystallization of the work-hardened metal. After this thermal treatment, the sheet can be cooled so as to obtain an uncoated sheet, or continuously hot-dip coated in a bath, using methods known per se, and finally cooled.

The inventors have shown that, among the fabrication steps detailed above, the step of reheating the slabs in a specific temperature range and holding time was the step that had the predominant influence on the characteristics of the nickel enriched layer on the final sheet. In particular, they have shown that the annealing cycle of the cold rolled sheet, whether it comprises a coating step or not, has only a secondary influence on the characteristics of the nickel enriched surface layer. In other words, except for the cold rolling reduction ratio, which thins the nickel enriched layer by a proportional quantity, the characteristics of the nickel enrichment of this layer are practically identical on a hot rolled sheet and on a sheet which additionally undergoes cold rolling and annealing, whether this comprises a step of hot-dip precoating or not.

This precoating can be aluminum, an aluminum alloy (comprising over 50% aluminum) or an aluminum-based alloy (where the aluminum is the majority constituent). Advantageously this precoating is an aluminum-silicon alloy comprising by weight 7% to 15% silicon, 2% to 4% iron and optionally between 15 ppm and 30 ppm calcium, the remainder being aluminum and inevitable impurities resulting from elaboration.

The precoating may also be an aluminum alloy containing 40% to 45% Zn, 3% to 10% Fe, 1% to 3% Si, the balance being aluminum and inevitable impurities resulting from elaboration.

According to an embodiment, the precoating can be an aluminum alloy, this being in intermetallic form containing iron. This type of precoating is obtained by a thermal pretreatment of the sheet precoated with aluminum or aluminum alloy. This thermal pretreatment is done at a temperature $\theta_1$ during a hold time $t_1$, such that the pre-coating no longer contains free aluminum of phase $\tau_5$ of type $Fe_3Si_2Al_{12}$ and $\tau_6$ of type $Fe_2Si_2Al_9$ and so as not to cause austenitic transformation in the steel substrate. Preferentially, the temperature $\theta_1$ is comprised between 620° C. and 680° C., and the holding time $t_1$ is comprised between 6 and 15 hours. In this way a diffusion of the iron from the steel sheet to the aluminum or aluminum alloy is obtained. This type of precoating then makes it possible to heat the blanks, before the hot stamping step, with a distinctly higher rate, which allows the high-temperature holding time during reheating of the blanks to be minimized, meaning reducing the quantity of hydrogen adsorbed during the step of heating the blanks.

Alternatively, the precoating can be galvanized or galvanized-alloyed, i.e., have a quantity of iron comprised between 7% to 12% after thermal alloying treatment performed in the in-line process immediately after the galvanization bath.

The precoating can also be composed of a superposition of layers deposited in successive steps, where at least one of the layers can be aluminum or an aluminum alloy.

After the fabrication described above, the sheets are cut or punched by methods known per se so as to obtain blanks whose geometry is related to the final geometry of the stamped and press hardened part. As explained above, cutting sheets comprising in particular between 0.32% and 0.36% C, between 0.40% and 0.80% Mn and between 0.05% and 1.20% Cr is particularly easy because of the relatively low mechanical strength at this stage, associated with a ferritic-pearlitic microstructure.

These blanks are heated up to a temperature comprised between 810° C. and 950° C. so as to austenitize completely the steel substrate, hot stamped, and then held in the press tool so as to obtain a martensitic transformation. The strain ratio applied during the hot stamping step can be smaller or larger according to whether a cold deformation step (stamping) has been done prior to the austenitization treatment. The inventors have shown that the thermal heating cycles for press hardening, which consist of heating the blanks near the Ac3 transformation temperature, and then holding them at this temperature for several minutes, do not cause noticeable change in the nickel enriched layer.

In other words, the characteristics of the nickel enriched surface layer are similar on the sheet before press hardening and on the part obtained from the sheet after press hardening.

Because the compositions from the invention have a lower Ac3 transformation temperature than conventional steel components, it is possible to austenitize the blanks with reduced temperatures-holding times, which serves to reduce the possible absorption of hydrogen in the heating furnaces.

As nonlimiting examples, the following embodiments illustrate the advantages conferred by the invention.

Example 1

Intermediate steel products were supplied with the composition appearing in Table 1 below.

TABLE 1

| | Steel Compositions (% by weight) | | | | | | | | | | | | | |
|---|---|---|---|---|---|---|---|---|---|---|---|---|---|---|
| Ref. | C (%) | Mn (%) | Al (%) | Si (%) | Cr (%) | Mo (%) | Ni (%) | Nb (%) | Ti (%) | P (%) | S (%) | B (%) | N (%) | P1 (%) |
| A | 0.35 | 0.62 | 0.027 | 0.69 | 0.51 | 0.20 | 0.41 | 0.04 | 0.02 | 0.01 | 0.001 | 0.0029 | 0.0040 | 1.11 |
| B | 0.35 | 0.62 | 0.031 | 0.70 | 0.51 | 0.20 | 0.79 | 0.04 | 0.02 | 0.01 | 0.001 | 0.0029 | 0.0040 | 1.11 |
| C | 0.35 | 0.61 | 0.035 | 0.69 | 1.05 | 0.20 | 0.79 | 0.04 | 0.02 | 0.01 | 0.001 | 0.0029 | 0.0050 | 1.15 |

TABLE 1-continued

| Steel Compositions (% by weight) | | | | | | | | | | | | | | |
|---|---|---|---|---|---|---|---|---|---|---|---|---|---|---|
| Ref. | C (%) | Mn (%) | Al (%) | Si (%) | Cr (%) | Mo (%) | Ni (%) | Nb (%) | Ti (%) | P (%) | S (%) | B (%) | N (%) | P1 (%) |
| D | 0.34 | 0.61 | 0.032 | 0.69 | 0.98 | 0.20 | 1.19 | 0.04 | 0.02 | 0.01 | 0.001 | 0.0028 | 0.0050 | 1.12 |
| E | 0.25 | 2.99 | 0.051 | 0.10 | 0 | 0 | 1 | 0.026 | 0.036 | 0.011 | 0.001 | 0.0024 | 0.0058 | 1.22 |
| F | 0.25 | 1.57 | 0.041 | 0.11 | 2.00 | 0.61 | 1.49 | 0 | 0.036 | 0.011 | 0.001 | 0.0024 | 0.0054 | 1.11 |
| G | 0.28 | 2.62 | 0.030 | 0.10 | 0 | 0.25 | 0 | 0 | 0.076 | 0.01 | 0.001 | 0.0024 | 0.0040 | 1.20 |
| H | 0.32 | 2.09 | 0.032 | 0.72 | 1.31 | 0.31 | 0 | 0 | 0.08 | 0.015 | 0.001 | 0.0021 | 0.0040 | 1.37 |
| I | 0.36 | 1.21 | 0.031 | 0.25 | 0.19 | 0 | 0 | 0 | 0.04 | 0.015 | 0.003 | 0.0030 | 0.0041 | 1.19 |
| J | 0.22 | 1.20 | 0.045 | 0.25 | 0.21 | 0 | 0 | 0 | 0.02 | 0.015 | 0.003 | 0.0030 | 0.0035 | 0.83 |
| K | 0.25 | 2.19 | 0.032 | 0.10 | 0 | 0 | 0 | 0.04 | 0 | 0.01 | 0.003 | 0.0030 | 0.0045 | 1 |

Underlined values do not comply with the invention.

These intermediate products were brought to 1275° C. and held at that temperature for 45 minutes, then hot rolled with an end of rolling temperature ERT of 950° C., and a coiling temperature of 650° C. The hot rolled sheets were then pickled in an acid bath with inhibitor so as to eliminate only the oxide layer created during the previous fabrication steps and then cold rolled to a thickness of 1.5 mm. The resulting sheets were cut into the shape of blanks. The suitability for mechanical cutting was evaluated by means of the force necessary for performing this operation. This property is in particular related to the mechanical strength and the hardness of the sheet at this stage. The blanks were then brought to the temperature indicated in Table 2 and held at this temperature 150 seconds before being hot stamped and cooled by holding in the press. The cooling speed, measured between 750° C. and 400° C., is comprised between 180° C./s and 210° C./s. The tensile mechanical strength Rm of the resulting parts, whose structure is martensitic, was measured using 12.5×50 ISO traction test samples.

Additionally, some blanks were heated to a temperature comprised between 850° C. and 950° C. for five minutes in a furnace under an atmosphere with a dewpoint of −5° C. These blanks were next hot stamped under conditions identical to those presented above. The diffusible hydrogen values on the resulting parts were then measured with a thermal desorption analysis (TDA) method known per se: in this method, a sample to be tested is heated to 900° C. in an infrared heating furnace under a flow of nitrogen. The hydrogen content coming from the desorption is measured as a function of the temperature. The diffusible hydrogen is quantified by the total hydrogen desorbed between ambient temperature and 360° C. The variation of the nickel content in the steel near the surface was also measured on the sheets implemented by hot stamping using glow discharge spectroscopy (GDOES, "Glow Discharge Optical Emission Spectrometry," a technique known per se). The values of the parameters $Ni_{max}$, $Ni_{surf}$, $Ni_{nom}$ and Δ can be defined this way.

The results of these tests are reported in Table 2.

TABLE 2

| Heating conditions of the blanks and properties resulting after press hardening. | | | | | | |
|---|---|---|---|---|---|---|
| Ref. | Suitability of the sheets for cutting | Heating temperature (° C.) | Rm (MPa) | $\frac{(Ni_{max}+Ni_{nom})}{2}\times(\Delta)$ (%/μm) | $\frac{(Ni_{max}-Ni_{nom})}{\Delta}$ (%/μm) | Diffusible hydrogen (ppm) |
| A | ○ | 900 | 1950 | 0.6 | 0.01 | 0.16 |
| B | ○ | 900 | 1950 | 3.1 | 0.75 | 0.10 |
| C | ○ | 900 | 1950 | 1.6 | 0.4 | 0.12 |
| D | ○ | 900 | 1950 | 2.0 | 0.91 | 0.13 |
| E | | 850 | 1962 | 10.6 | 0.02 | 0.09 |
| F | | 850 | 1803 | 10.4 | 0.025 | 0.08 |
| G | | 850 | 1965 | 0 | 0 | 0.32 |
| H | | 900 | 2069 | 0 | 0 | 0.29 |
| I | ○ | 900 | 1981 | 0 | 0 | 0.25 |
| J | ○ | 900 | 1538 | 0 | 0 | 0.27 |
| K | | 900 | 1769 | 0 | 0 | 0.30 |

Underlined values do not comply with the invention.
○ = sheet more specifically suited to cutting The sheets A-D are particularly well-suited to cutting because of their ferritic-pearlitic structure. The press hardened sheets and parts A-F have characteristics in terms of composition and nickel enhanced surface layer corresponding to the invention.

The examples A-D show that a composition containing in particular a C content comprised between 0.32% and 0.36%, Mn content comprised between 0.40% and 0.80%, a chromium content comprised between 0.05% and 1.20% in combination with a nominal nickel content of 0.30% to 1.20% and a specific layer enriched in this element serve to result in a strength Rm over 1950 MPa and a diffusible hydrogen content at a value less than or equal to 0.16 ppm.

The example from test A shows that the nickel content can be lowered between 0.30% and 0.50% which serves to obtain satisfactory results in terms of mechanical resistance and resistance to delayed cracking under economical fabrication conditions.

The examples E-F show that satisfactory results can be obtained with a composition containing in particular a carbon content comprising between 0.24% and 0.28% and a manganese content comprising between 1.50% and 3%. The high value of the parameter $$\frac{(Ni_{max} + Ni_{nom})}{2} \times (\Delta)$$

is associated with a particularly low diffusible hydrogen content.

Conversely, the parts from examples G-K have a diffusible hydrogen content over 0.25 ppm because the steels do not have a nickel enriched surface layer. Further, examples J-K correspond to steel compositions for which the parameter $P_1$ is below 1.1% such that a strength Rm of 1800 MPa is not obtained after press hardening.

Figure 5:
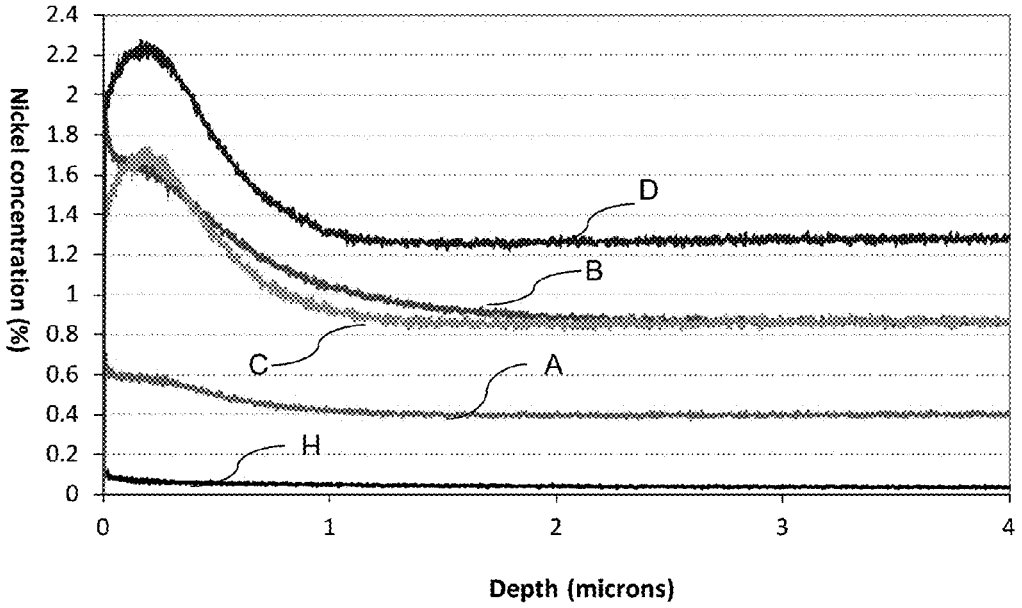
FIG. 5 shows the variation in nickel content near the surface of sheets having different compositions.

For the steel compositions A-D and H, i.e., the ones for which the carbon content is comprised between 0.32% and 0.35%, FIG. 5 shows the nickel content as a function of depth measured compared to the surface of the sheet as measured by GDOES technique. The reference letters appearing beside each curve in this figure correspond to the steel reference. In contrast to a sheet that does not contain nickel (reference H), it can be seen that the sheets according to the invention have an enrichment in the surface layer. At a given nominal nickel content (0.79%), it is noted from examples B and C that a variation of the chromium content from 0.51% to 1.05% serves to preserve enrichment in the surface layer, satisfying the conditions of the invention.

Example 2

Hot rolled steel sheets with the composition corresponding to that of steels E and F above, i.e., containing nickel contents of 1% and 1.49% respectively and fabricated under the conditions mentioned above, were supplied.

After rolling, the sheets underwent two types of preparation:

X: acid pickling with inhibitor so as to only remove the oxide layer; and

Y: grinding of 100 μm.

Figure 6:
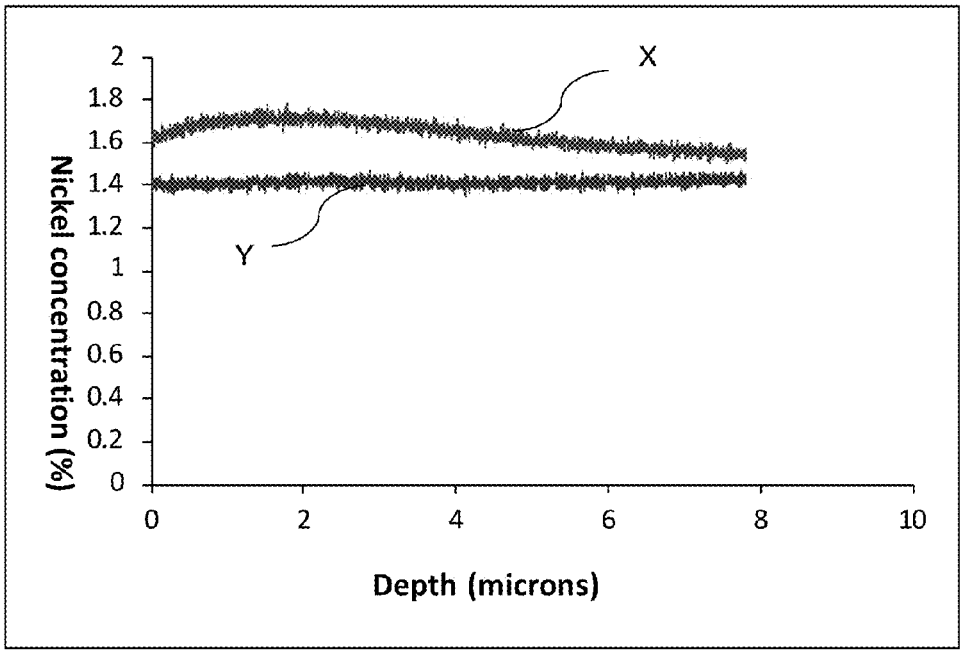
FIG. 6 shows the variation in nickel content near the surface of sheets of identical composition that have undergone two modes of surface preparation before press hardening.

FIG. 6, which shows the nickel content measured by glow discharge spectroscopy from the surface of the sheet F, shows that in the preparation mode X, a nickel enriched surface layer is present (curve labeled X), whereas the grinding eliminated the oxide layer and the nickel enriched sublayer (curve labeled Y).

After cold rolling to a thickness of 1.5 mm, blanks thus prepared were next heated to 850° C. in a furnace at a speed of 10° C./s, held at that temperature for five minutes and then hot stamped. In the two modes of preparation, the following is the diffusible hydrogen content measured on the stamped parts:

| Prior preparation of the sheet | Part E: Diffusible hydrogen content (ppm) | Part F: Diffusible hydrogen content (ppm) |
|---|---|---|
| Pickling retaining the nickel enriched layer | 0.09 | 0.08 |
| Grinding eliminating the nickel enriched layer | 0.21 | 0.19 |

Figure 7:
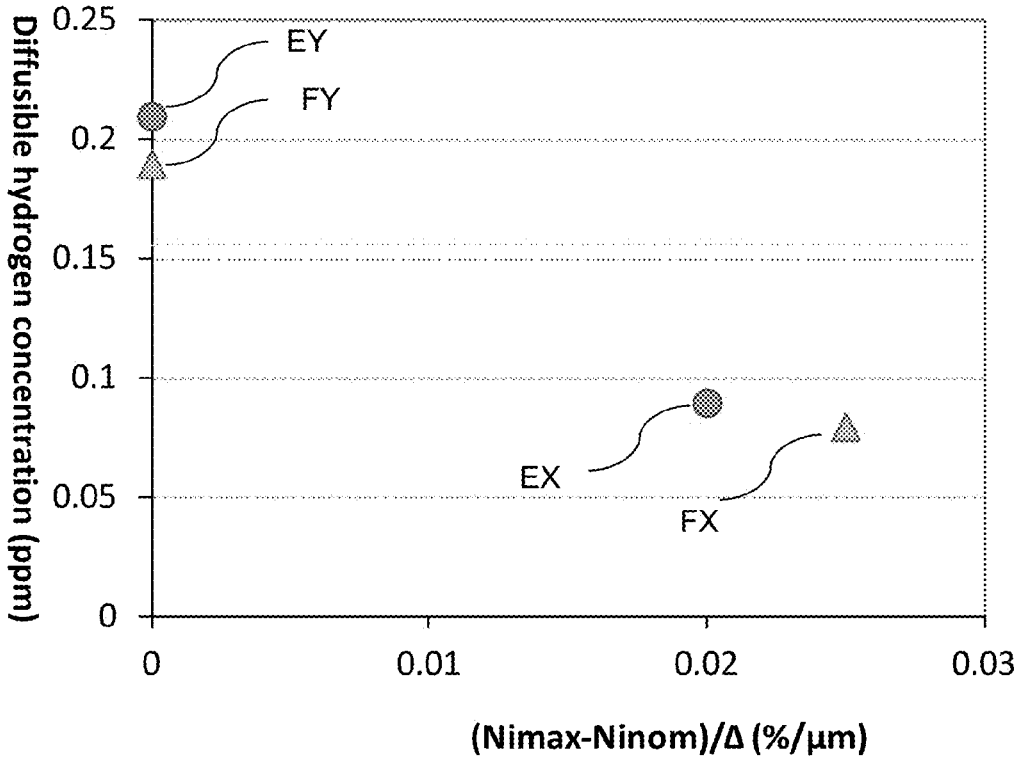
FIG. 7 shows the variation of diffusible hydrogen content as a function of the amount of nickel enrichment in the surface layer, for sheets that have undergone two surface preparation modes before press hardening.

FIG. 7 shows the diffusible hydrogen content as a function of the steel composition and the preparation mode. For example, the reference EX relates to the sheet and hot stamped part made from steel composition E with preparation mode X.

These results show that a nickel enriched surface layer, i.e., showing a sufficient nickel content gradient, is necessary to obtain a low diffusible hydrogen content.

Example 3

Slabs, 235 mm thick, were prepared with the following composition:

TABLE 3

| Steel Composition (% by weight) | | | | | | | | | | | | | |
|---|---|---|---|---|---|---|---|---|---|---|---|---|---|
| C (%) | Mn (%) | Al (%) | Si (%) | Cr (%) | Mo (%) | Ni (%) | Nb (%) | Ti (%) | P (%) | S (%) | B (%) | N (%) | P1 (%) |
| 0.35 | 0.65 | 0.043 | 0.58 | 0.38 | 0.19 | 0.39 | 0.039 | 0.033 | 0.004 | 0.001 | 0.0029 | 0.005 | 1.1 |

These slabs were brought to 1290° C. and held at that temperature for 30 minutes.

They were next hot rolled to a thickness of 3.2 mm according to various rolling or coiling end temperatures. The tensile mechanical properties (yield stress Re, tensile strength Rm, total elongation Et) of these hot rolled sheets are reported in Table 4.

TABLE 4

| Implementation conditions of hot rolled sheets and resulting mechanical properties | | | | | |
|---|---|---|---|---|---|
| Test reference | End of rolling temperature (° C.) | Coiling temperature (° C.) | Re (MPa) | Rm (MPa) | Et (%) |
| T | 940 | 660 | 506 | 718 | 18.5 |
| U | 870 | 650 | 507 | 726 | 19.2 |
| V | 900 | 580 | 578 | 762 | 17.4 |

At nearly identical coiling temperature (tests T and U), it is observed that an end of rolling temperature variation of 70° C. has only a very small influence on the mechanical properties. At neighboring end of rolling temperature (tests U and V), it is observed that a reduction of the coiling temperature from 650° C. to 580° C. has only a fairly small influence, in particular on the strength which varies less than 5%. It has thus been shown that steel sheet fabricated under the conditions of the invention is not sensitive to fabrication variations, resulting in the rolled bands having good homogeneity.

Figure 8:
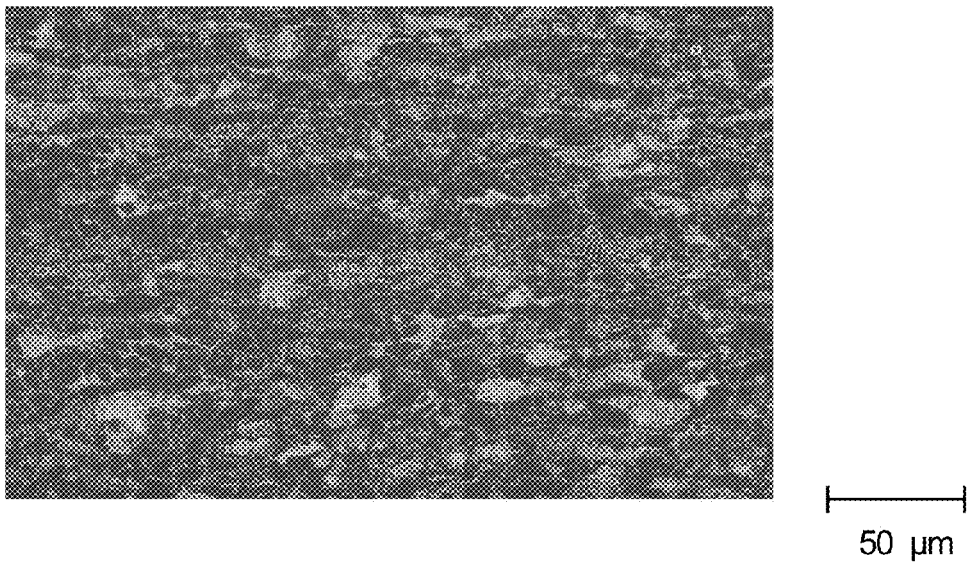
FIGS. 8 and 9 show the structures of hot rolled sheets according to the invention.
Figure 9:
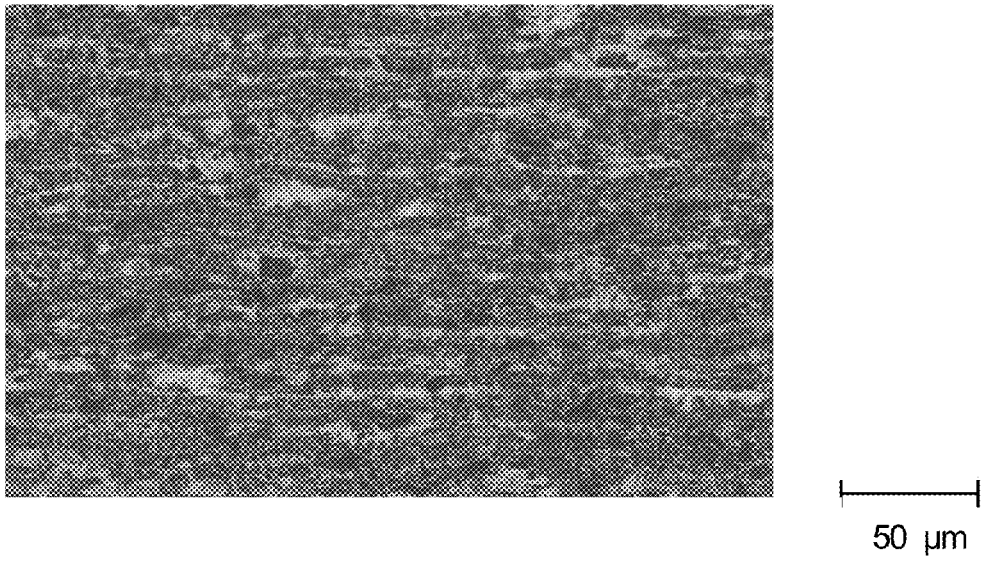

FIGS. 8 and 9 show hot rolled sheets from the tests T and V respectively. It can be seen that the ferritic-pearlitic microstructures are very similar for the two conditions.

The hot rolled sheets were continuously pickled so as to remove only the oxide layer formed in the prior steps while leaving the nickel enriched layer in place. The sheets were next rolled to a target thickness of 1.4 mm. Whatever the hot rolling condition, the desired thickness was able to be achieved; the rolling forces being similar for the various conditions.

The sheets were then annealed at a temperature of 760° C., which is immediately above the Ac1 transformation temperature, and then cooled and continuously aluminated by tempering in a bath containing 9% silicon by weight, 3% iron by weight and the remainder aluminum and inevitable impurities. The result is thus sheets with a coating on the order of 80 g/m$^2$ per surface; this coating has a very regular defect-free thickness.

The blanks resulting from the conditions of test T in Table 4 above were then cut, heated under various conditions and hot stamped. In all cases, the resulting fast cooling gave the steel substrate a martensitic structure. Some parts additionally underwent a paint baking thermal cycle.

TABLE 4

Implementation conditions of hot rolled sheets and resulting mechanical properties

| Test reference | Heating temperature/ furnace hold time | Paint baking cycle | Re (MPa) | Rm (MPa) | Et (%) |
|---|---|---|---|---|---|
| T1 | 900° C. 7 min. | None | 1337 | 1944 | 6.5 |
| T2 | 900° C. 7 min. | 170° C. 20 min. | 1495 | 1825 | 7.4 |
| T3 | 930° C. 10 min. | None | 1296 | 1915 | 7 |
| T4 | 930° C. 10 min. | 170° C. 20 min. | 1471 | 1827 | 7.5 |

It is observed that the resulting resistance exceeds 1800 MPa, whatever the temperature and holding time of the blank in the furnace, with or without subsequent paint baking treatment.

Example 4

Cold rolled and annealed steel sheets 1.4 mm thick with compositions corresponding to that of steels A and J above, i.e., containing a nickel content of 0.39% and 0%, respectively, and fabricated under the conditions indicated in Example 1, were supplied. Next, a coating was applied by hot-dip in a bath whose composition is described in Example 3. This resulted in sheets with a 30 μm thick aluminum alloy precoating from which blanks were cut.

These blanks were austenitized in a furnace at a maximum temperature of 900° C. in an atmosphere with a controlled dewpoint of −10° C. and the total holding time of the blanks in the furnace was 5 or 15 minutes. After austenitization, the blanks were quickly transferred from the furnace to a hot stamping press and quenched by holding in the tool. The test conditions reported in Table 5 are representative of an industrial thin sheet hot stamping method.

TABLE 5

Conditions for performing hot stamping tests on blanks with aluminum alloy precoating

| | Austenitization furnace parameters | | | Hot stamping parameters | | |
|---|---|---|---|---|---|---|
| Test condition | Dew-point (° C.) | Temp. (° C.) | Hold time (min.) | Transfer time (sec.) | Applied pressure (kN) | Quenching time in tool (sec.) |
| 5 | −10 | 900 | 5 | 8 | 5500 | 6 |
| 6 | −10 | 900 | 15 | 8 | 5500 | 6 |

The tensile mechanical properties (resistance Rm and total elongation Et) and the diffusible hydrogen content were measured on the press hardened parts and reported in Table 6.

TABLE 6

Mechanical properties and diffusible hydrogen content obtained on press hardened parts with aluminum alloy precoating

| Test reference | Steel reference | Paint baking cycle | Mechanical properties Rm (MPa) | Mechanical properties Et (%) | Diffusible hydrogen (ppm) |
|---|---|---|---|---|---|
| A5 | A | None | 1912 | 6.2 | 0.07 |
| J5 | J | None | 1537 | 6.3 | 0.18 |
| A6 | A | None | 1923 | 6 | 0.09 |
| J6 | J | None | 1528 | 6 | 0.2 |

It is observed that the resulting strength of parts A5-A6 exceeds 1800 MPa and that the diffusible hydrogen content is below 0.16 ppm, whereas for the parts J5-J6, the strength is below 1800 MPa and the diffusible hydrogen content is over 0.16 ppm. Under the conditions of the invention, the characteristics of strength and hydrogen content of the parts vary little as a function of the holding time in the furnace, which assures a very stable production.

Thus, press hardened parts simultaneously having a very high mechanical strength and a resistance to delayed cracking can be fabricated with the invention. These parts will be profitably used as structural or reinforcing parts in the field of automotive manufacturing.

What is claimed is:

1. A rolled steel sheet for press hardening comprising:

a chemical composition including, with contents expressed by weight:

0.24%≤C≤0.38%;

0.40%≤Mn≤3%;

0.10%≤Si≤0.70%;

0.015%≤Al≤0.070%;

0%≤Cr≤2%;

0.25%≤Ni≤2%;

0.015%≤Ti≤0.10%;

0%≤Nb≤0.060%;

0.0005%≤B≤0.0040%;

0.003%≤N≤0.010%;

0.0001%≤S≤0.005%; and 0.0001%≤P≤0.025%;

the titanium and nitrogen contents satisfying Ti/N>3.42;

the carbon, manganese, chromium and silicon contents satisfying:

$$2.6C + \frac{Mn}{5.3} + \frac{Cr}{13} + \frac{Si}{15} \geq 1.1\%$$

a remainder of the chemical composition being made up of iron and inevitable impurities resulting from processing;

a nickel content $Ni_{surf}$ at any point of the steel near a surface of the sheet over a depth Δ, such that $Ni_{surf} > Ni_{nom}$, wherein $Ni_{nom}$ is a nominal nickel content of the steel;

a maximum nickel content $Ni_{max}$ within Δ being:

$$\frac{(Ni_{max} + Ni_{nom})}{2} \times (\Delta) \geq 0.6,$$

and:

$$\frac{(Ni_{max} + Ni_{nom})}{\Delta} \geq 0.01$$

with the depth Δ expressed in microns and $Ni_{max}$ and $Ni_{nom}$ expressed in percentages by weight.

2. Steel sheet according to claim 1, wherein the chemical composition includes at least one of the following elements, by weight:

0.05%≤Mo≤0.65%;

0.001%≤W≤0.30%; and 0.0005%≤Ca≤0.005%.

3. Steel sheet according to claim 1, wherein the chemical composition includes, by weight:

0.32%≤C≤0.36%;

0.40%≤Mn≤0.80%; and 0.05%≤Cr≤1.20%.

4. Steel sheet according to claim 1, wherein the chemical composition thereof includes, by weight:

0.24%≤C≤0.28%; and 1.50%≤Mn≤3%.

5. Steel sheet according to claim 1, wherein the chemical composition includes, by weight:

0.50%≤Si≤0.60%.

6. Steel sheet according to claim 1, wherein the chemical composition includes, by weight:

0.30%≤Cr≤0.50%.

7. Steel sheet according to claim 1, wherein the chemical composition includes, by weight:

0.30%≤Ni≤1.20%.

8. Steel sheet according to claim 1, wherein the chemical composition includes, by weight:

0.30%≤Ni≤0.50%.

9. Steel sheet according to claim 1, wherein the chemical composition thereof comprises, by weight:

0.020%≤Ti.

10. Steel sheet according to claim 1, wherein the chemical composition includes, by weight:

0.020%≤Ti≤0.040%.

11. Steel sheet according to claim 1, wherein the chemical composition includes, by weight:

0.15%≤Mo≤0.25%.

12. Steel sheet according to claim 1, wherein the chemical composition includes, by weight:

0.010%≤Nb≤0.060%.

13. Steel sheet according to claim 1, wherein the chemical composition includes, by weight:

0.030%≤Nb≤0.050%.

14. Steel sheet according to claim 3, wherein the chemical composition includes, by weight:

0.50%≤Mn≤0.70%.

15. Steel sheet according to claim 3, further comprising a ferritic-pearlitic microstructure.

16. Steel sheet according to claim 1, wherein the sheet is a hot rolled sheet.

17. Steel sheet according to claim 1, wherein the sheet is a cold rolled and annealed sheet.

18. Steel sheet according to claim 1, wherein the sheet is precoated with a metal layer of aluminum or aluminum alloy or aluminum-based alloy.

19. Steel sheet according to claim 1, wherein the sheet is precoated with a metal layer of zinc or zinc alloy or zinc-based alloy.

20. Steel sheet according to claim 1, wherein the sheet is precoated with at least one coat of inter-metallic alloy including aluminum and iron and wherein the precoating does not include free aluminum, of phase $\tau_5$ of type $Fe_3Si_2Al_{12}$, and $\tau_6$ of type $Fe_2Si_2Al_9$.

21. Steel sheet according to claim 20, wherein the at least one coat of inter-metallic alloy includes silicon.

22. A part obtained by press hardening a steel sheet of the chemical composition according to claim 1 with a martensitic or martensitic-bainitic structure.

23. A press hardened part according to claim 22, comprising a nominal nickel content $Ni_{nom}$, wherein the nickel content $Ni_{surf}$ in the steel near the surface is greater than $Ni_{nom}$ over a depth Δ, and a maximum nickel content $Ni_{max}$ within Δ is:

$$\frac{(Ni_{max} + Ni_{nom})}{2} \times (\Delta) \geq 0.6,$$

and:

$$\frac{(Ni_{max} + Ni_{nom})}{\Delta} \geq 0.01$$

with the depth Δ expressed in microns, and the contents $Ni_{max}$ and $Ni_{nom}$ expressed in percentages by weight.

24. A press hardened part according to claim 22, wherein a mechanical strength Rm is greater than or equal to 1800 MPa.

25. A press hardened part according to claim 22, further comprising an aluminum or aluminum-based alloy, or a zinc or a-based alloy resulting from diffusion between the steel substrate and a precoat, during a thermal treatment of press hardening.

26. A structural or reinforcing part for an automotive vehicle comprising:

a press hardened part according to claim 22.

* * * * *